US010549164B2

(12) United States Patent
Nelson et al.

(10) Patent No.: US 10,549,164 B2
(45) **Date of Patent: *Feb. 4, 2020**

(54) COLLAPSIBLE AND PORTABLE SPORTS NET APPARATUS

(71) Applicant: TRIAD SPORTS GROUP, LLC, Camarillo, CA (US)

(72) Inventors: David Nelson, Camarillo, CA (US); John Lucas, Camarillo, CA (US)

(73) Assignee: TRIAD SPORTS GROUP, LLC, Camarillo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/612,899

(22) Filed: Jun. 2, 2017

(65) Prior Publication Data

US 2017/0266527 A1 Sep. 21, 2017

Related U.S. Application Data

(63) Continuation of application No. 15/068,354, filed on Mar. 11, 2016, now Pat. No. 9,750,996, which is a (Continued)

(51) Int. Cl.
*A63B 63/00* (2006.01)
*A63B 69/00* (2006.01)
(Continued)

(52) U.S. Cl.
CPC ..... *A63B 69/00* (2013.01); *A63B 61/00* (2013.01); *A63B 63/00* (2013.01); *A63B 71/022* (2013.01);
(Continued)

(58) Field of Classification Search
CPC . A63B 63/04; A63B 2210/50; A63B 2210/52; A63B 2210/54; A63B 61/02; A63B 61/04; A63B 63/00; A63B 63/004
(Continued)

(56) References Cited

U.S. PATENT DOCUMENTS 1,922,021 A 8/1933 Adams
3,013,801 A 12/1961 Kirkconnell, Jr.
(Continued)

FOREIGN PATENT DOCUMENTS

DE 202013104280 U1 10/2013
JP D1191670 S 12/2003
(Continued)

OTHER PUBLICATIONS

International Preliminary Report and Written Opinion from PCT/US2012/040557, dated Dec. 12, 2013.
(Continued)

*Primary Examiner* — Mark S Graham
(74) *Attorney, Agent, or Firm* — Arent Fox, LLP

(57) ABSTRACT

A net apparatus arranged to provide a net structure to capture or catch a projectile, that is easy to setup and is collapsible such that the frame structure is easy to assemble by a single individual. The net apparatus comprising a base structure including at least one support portion, at least one base extension, and a hinge, wherein the at least one support portion is coupled to the at least one base extension and the hinge. At least one rod is removably coupled to the base structure and received by a net, wherein the net is adapted to exert a force on the at least one rod causing the at least one rod to exert a force onto said hinge in order to lock the at least one support portion.

25 Claims, 3 Drawing Sheets

Related U.S. Application Data continuation of application No. 13/485,775, filed on May 31, 2012, now Pat. No. 9,283,455.

(60) Provisional application No. 61/492,010, filed on Jun. 1, 2011.

(51) Int. Cl.
*A63B 61/00* (2006.01)
*A63B 71/02* (2006.01)
*A63B 102/18* (2015.01)

(52) U.S. Cl.
CPC ..... *A63B 2071/026* (2013.01); *A63B 2102/18* (2015.10); *A63B 2209/02* (2013.01); *A63B 2210/50* (2013.01); *A63B 2225/055* (2013.01); *A63B 2243/0025* (2013.01)

(58) Field of Classification Search
USPC ..... 273/398–402, 395, 396; 473/478, 434, 473/435, 490, 492–495
See application file for complete search history.

(56) References Cited

U.S. PATENT DOCUMENTS 3,039,770 A 5/1962 Ferretti
3,195,898 A * 7/1965 Respini ..... A63B 63/00 135/118
3,197,208 A 7/1965 Makar
3,428,319 A 2/1969 Engle
3,583,703 A 6/1971 Brown
4,093,218 A 6/1978 Burchers
4,173,340 A 11/1979 Kanno
4,258,915 A 3/1981 Sellge, Jr.
4,274,632 A 6/1981 Jacobs
4,456,251 A 6/1984 Balaz
4,489,941 A 12/1984 Shieh
4,723,780 A 2/1988 Vinzetta
5,080,375 A 1/1992 Moosavi
5,100,134 A 3/1992 Becker
5,118,103 A 6/1992 Miller
5,249,796 A 10/1993 Silvi
5,269,527 A * 12/1993 Noval ..... A63B 71/022 473/197
5,269,533 A 12/1993 Kellams
5,333,856 A 8/1994 Gery
5,539,957 A 7/1996 Schmidt
5,562,288 A 10/1996 Erkebaev
5,564,711 A 10/1996 Scheie
5,569,102 A 10/1996 Karron
D377,673 S 1/1997 Henrickson
5,690,339 A 11/1997 Chen
5,746,533 A 5/1998 Schmidt
5,816,946 A 10/1998 Grossman
5,816,956 A 10/1998 Ellis et al.
5,839,733 A 11/1998 Meeks et al.
D415,805 S 10/1999 Wygonik
6,210,288 B1 4/2001 Kim
6,299,554 B1 10/2001 Sinclair
6,315,677 B1 11/2001 Sandlin
6,358,163 B1 3/2002 Tanner
6,371,873 B1 4/2002 Wang
6,511,390 B2 1/2003 Kim
6,672,980 B1 1/2004 Walsh
6,682,445 B1 1/2004 Tanner
6,716,123 B1 4/2004 Chen
D514,638 S 2/2006 deGrasse
D531,684 S 11/2006 Bouffard et al.
7,371,195 B2 5/2008 Stevens
D591,358 S 4/2009 Moore
D627,002 S 11/2010 Cho
D638,079 S 5/2011 Cheng
8,216,092 B2 7/2012 Wennesland
8,216,093 B2 7/2012 Chen
20,172,153 7/2012 Newman
8,246,496 B2 * 8/2012 Holland ..... A63B 63/004 473/478
8,579,737 B2 11/2013 Holland
8,734,274 B1 5/2014 Hochberg
D709,970 S 7/2014 Holland
8,875,772 B1 11/2014 Dixon, Jr.
9,126,127 B2 9/2015 Jablonski
9,220,965 B1 12/2015 Hochberg
9,283,455 B2 * 3/2016 Nelson ..... A63B 61/00
9,463,367 B2 10/2016 Holland
9,480,894 B2 11/2016 Holland
9,750,996 B2 * 9/2017 Nelson ..... A63B 61/00
9,795,849 B2 * 10/2017 Nelson ..... A63B 69/00
9,795,857 B2 * 10/2017 Nelson ..... A63B 71/022
9,999,816 B2 6/2018 Holland
10,124,233 B2 11/2018 Nelson
10,183,206 B2 1/2019 Nelson
10,226,679 B2 3/2019 Nelson
2002/0193186 A1 12/2002 Kim
2003/0036446 A1 2/2003 Udwin et al.
2003/0153412 A1 8/2003 Duba et al.
2004/0036222 A1 2/2004 Chou
2004/0127308 A1 7/2004 Swanson
2004/0138011 A1 7/2004 Lin
2004/0185968 A1 9/2004 Livingston
2005/0266936 A1 12/2005 Gutierrez
2006/0019773 A1 1/2006 Newman
2006/0205540 A1 9/2006 Liu
2006/0232013 A1 10/2006 Quinn
2007/0087869 A1 4/2007 Lin
2007/0105662 A1 5/2007 Tanner
2007/0281805 A1 12/2007 Hsiao
2008/0064534 A1 3/2008 Lortscher
2008/0139343 A1 6/2008 Sandman
2009/0082140 A1 3/2009 Liao
2010/0184538 A1 7/2010 Reeves
2010/0304902 A1 12/2010 Holland et al.
2011/0074111 A1 3/2011 Jackson
2011/0136592 A1 6/2011 Keller
2011/0230284 A1 9/2011 Simon
2011/0287872 A1 11/2011 Lynch
2012/0190482 A1 7/2012 Cottreau
2013/0175414 A1 7/2013 Nelson
2013/0210554 A1 8/2013 Carlson
2013/0252766 A1 9/2013 Nelson
2013/0303313 A1 11/2013 Chen
2014/0171225 A1 6/2014 Paulson
2014/0295999 A1 10/2014 Robinson
2014/0364255 A1 12/2014 Nelson
2015/0057109 A1 2/2015 Chen
2015/0148152 A1 5/2015 Holland
2015/0151179 A1 6/2015 Holland et al.
2015/0165289 A1 6/2015 Chen
2015/0231470 A1 8/2015 Kanner
2016/0023072 A1 1/2016 Holland et al.
2016/0096097 A1 4/2016 Erlandson
2017/0056741 A1 3/2017 Nelson
2017/0106266 A1 4/2017 Nelson
2017/0304701 A1 10/2017 Nelson et al.
2018/0185727 A1 7/2018 Nelson et al.

FOREIGN PATENT DOCUMENTS

JP D1200560 S 3/2004
JP 3100716 5/2004
JP 2011024660 2/2011
KR 920008138 11/1992
WO 2012167155 A2 12/2012

OTHER PUBLICATIONS

International Search Report and Written Opinion from PCT/US2012/040557, dated Dec. 14, 2012.
Bownet "The Mini" YouTube video, https://www.youtube.com/watch?v=U0gBsj1Qgdg, published Nov. 18, 2008.
Bownet "Bownet Lacrosse (LAX)" YouTube video, https://www.youtube.com/watch?v=AJGAIG3NzdM, published Nov. 18, 2008.

(56) References Cited

OTHER PUBLICATIONS

Bownet "Big Mouth Drills" YouTube video, https://www.youtube.com/watch?v=XjD1EBBf3rl, published Jan. 6, 2009.
Bownet "7x14 SetUp" YouTube video, https://www.youtube.com/watch?v=hTVhyRfq5u0, published Jul. 14, 2009.
Bownet "Barrier Net Set up" YouTube video, https://www.youtube.com/watch?v=bcRc9Yy9-hc, published Feb. 28, 2010.
Bownet "6.5x18 SetUp" YouTube video, https://www.youtube.com/watch?v=Kaq3YCkO1310, published Jul. 14, 2009.
Bownet "Backstop up & Down" YouTube video, https://www.youtube.com/watch?v=gfqHjPfWuq8, published Jul. 15, 2009.
Bownet "Barrier Net 'Take Down'.mov" YouTube video, https://www.youtube.com/watch?v=iyazwJe70fl, published Mar. 4, 2010.
Bownet "BowNet 5x10 shots" YouTube video, https://www.youtube.com/watch?v=oDS0doGxKqU, published Jan. 20, 2009.
Bownet "BowNet 6x12 shots" YouTube video, https://www.youtube.com/watch?v=KTVdKSRrPwg, published Jan. 20, 2009.
Bownet "Bownet Screen Pitching" YouTube video, https://www.youtube.com/watch?v=71u-vOs3TV4, published Jan. 6, 2009.
Bownet "Lacrosse Demo.mov" YouTube video, https://www.youtube.com/watch?v=ar6WspWjP3w, published Jan. 3, 2010.
Bownet "SetUp New 4x8" YouTube video, https://www.youtube.com/watch?v=evSHlhEVcsU, published Jul. 14, 2009.
Bownet "Softtoss net set up" YouTube video, https://www.youtube.com/watch?v=yD2HM9RHcxo, published Jan. 21, 2009.
Bownet "The BowNet 5x10" YouTube video, https://www.youtube.com/watch?v=jP3TW1nEoEs, published Jan. 20, 2009.
Bownet "The BowNet 6x12" YouTube video, https://www.youtube.com/watch?v=kipbgs1ULWA, published Jan. 20, 2009.
Bownet "12' x 3' Barrier / Tennis Net Set up", YouTube video, https://www.youtube.com/watch?v=MX08s9Djf8s, published Jan. 10, 2011.
Bownet "18' x 2' 9" Portable Barrier / Tennis Net Set up", YouTube video, https://www.youtube.com/watch?v=IOVRkq_hlXs, published Nov. 6, 2011.
Bownet "18' Youth Tennis Net Take Down" YouTube video, https://www.youtube.com/watch?v=7qySTevtZH8, published Nov. 9, 2011.
Bownet "Bownet 8x24 Set up", YouTube video, https://www.youtube.com/watch?v=Oapc5oXdhSc, published Jan. 9, 2011.
Bownet "Bownet 8x24 Take Down", YouTube video, https://www.youtube.com/watch?v=CbFmS61t0vY, published Jan. 9, 2011.
Bownet "Bownet Solo Kicker Set up", YouTube video, https://www.youtube.com/watch?v=aAQVIISKo-Y, published Jan. 5, 2011.
Bownet "Bownet Solo Kicker Take Down", YouTube video, https://www.youtube.com/watch?v=AI3UBhsNVM8, published Jan. 5, 2011.
Bownet "Can't Knock Down the Bownet", YouTube video, https://www.youtube.com/watch?v=0xC2xECHJ84, published Dec. 19, 2011.
Bownet "Field Hockey Take Down", YouTube video, https://www.youtube.com/watch?v=zVrmvMWuF_A, published Nov. 15, 2011.
Bownet Field Hockey Set up , YouTube video, https://www.youtube.com/watch?v=aY5Y9kpebJA, published Nov. 15, 2011.
Bownet "Hitting Station Set up", YouTube video, https://www.youtube.com/watch?v=0R2eK8xiyUY, published Nov. 6, 2011.
Bownet "Hitting Station Take Down", YouTube video, https://www.youtube.com/watch?v=6E3bHzBVRL4, published Dec. 4, 2011.
Bownet "Lacrosse Halo Set up", YouTube video, https://www.youtube.com/watch?v=5jSR28apetA, published Jan. 18, 2011.
Bownet "'L' Screen Set up", YouTube video, https://www.youtube.com/watch?v=id7oYUqDqlw, published Mar. 29, 2012.
Bownet "Pitching Screen Demo", YouTube video, https://www.youtube.com/watch?v=-ullBby-opQ, published Dec. 15, 2011.
Bownet "QB5 Pocket Net Take Down", YouTube video, https://www.youtube.com/watch?v=S4rISPDB2nc, published Dec. 4, 2011.
Bownet "QB5 'Set Up'", YouTube video, https://www.youtube.com/watch?v=eIGJ2sgw8GM, published Dec. 4, 2011.
Bownet "Solo Kicker Demo", YouTube video, https://www.youtube.com/watch?v=4I-8PMhP5Aw, published Jun. 13, 2011.
Bownet "Volleyball Hitting Station Demo", YouTube video, https://www.youtube.com/watch?v=_LieCF1_dM0, published Apr. 13, 2012.
Bownet "Volleyball Hitting Station Set up", YouTube video, https://www.youtube.com/watch?v=peQf6U2bXxE, published Nov. 9, 2011.
Bownet "Volleyball Hitting Station Take Down", YouTube video, https://www.youtube.com/watch?v=-iP-BmT-72g, published Nov. 9, 2011.
Bownet, Bownet Portable Lacrosse Goal, YouTube video (Jan. 11, 2009): https://www.youtube.com/watch?v=avtL47x4yoo.
Bownet, The Bownet Will Take Abuse, YouTube video (Nov. 18, 2008): https://www.youtube.com/watch?v=0lh51KY0bFA.
Bownet, Bownet Big Mouth, YouTube video (Jan. 21, 2009): https://www.youtube.com/watch?v=D6HAraGpAdl.
Bownet, Strike Zone Set up, YouTube video (Jan. 25, 2009): https://www.youtube.com/watch?v=Y0EJjJaVz-o.
Bownet, US Lacrosse Convention 2009, YouTube video (Jan. 26, 2009): https://www.youtube.com/watch?v=erxobnMRsfQ.
Bownet, Strike Zone Pitching, YouTube video (Feb. 18, 2009): https://www.youtube.com/watch?v=h6_84TtFUl4.
Bownet, Sandbag Demo, YouTube video (Jul. 14, 2009): https://www.youtube.com/watch?v=KraTVKH549g.
Bownet, Backstop Drills, YouTube video (Jul. 15, 2009): https://www.youtube.com/watch?v=e-26ils7tXo.
Bownet, 7x14 Training Session, YouTube video (Oct. 24, 2009): https://www.youtube.com/watch?v=y-x9GGu4aaY.
Bownet, Soft Toss and Bigmouth Demo, YouTube video (Nov. 23, 2009): https://www.youtube.com/watch?v=IGdgSoTLLNY.
Bownet, Soccer Net Demo, YouTube video (Nov. 24, 2009): https://www.youtube.com/watch?v=4LOxlwoUzRA.
Bownet, Crease Set Up-Down, YouTube video (Dec. 31, 2009): https://www.youtube.com/watch?v=nKApo0tsj1c.
Bownet, Barrier Net Soccer Demo, YouTube video (Jan. 18, 2010): https://www.youtube.com/watch?v=0NZ86SWigxM.
Bownet, DMS11 Practice, YouTube video (Feb. 19, 2010): https://www.youtube.com/watch?v=OaW5j9_FrA4.
Bownet, Final Bownet Guard1, YouTube video (Mar. 11, 2010): https://www.youtube.com/watch?v=od8OHFFM1dU.
Bownet, Bownet 8x24, YouTube video (Oct. 21, 2010): https://www.youtube.com/watch?v=XKLsGhbhRvE.
Bownet, Bownet SnapZone Set up, YouTube video (Jan. 5, 2011): https://www.youtube.com/watch?v=MDrlqmTfHVA.
Bownet, Lacrosse Demo 2011, YouTube video (Jan. 19, 2011): https://www.youtube.com/watch?v=OAimgUUXHmk.
Bownet, Bownet Soccer Demo, YouTube video (Jan. 18, 2010): https://www.youtube.com/watch?v=ORrlbNSvhdw.
Bownet, Ladies Crease and 8m Arc Set up, YouTube video (Nov. 9, 2011): https://www.youtube.com/watch?v=ohF81rLyTPM.
Bownet, Ladies 8m Arc Take Down, YouTube video (Jan. 30, 2012): https://www.youtube.com/watch?v=VvTZI9pYlic.
Bownet, Volleyball Setting Net Demo, YouTube video (Apr. 16, 2012): https://www.youtube.com/watch?v=FWfcXVKly28.
Bownet, Bownet Solo Kicker, YouTube video (Jan. 4, 2011): https://www.youtube.com/watch?v=-efeeqAy0xE.

* cited by examiner

FIG. 2c
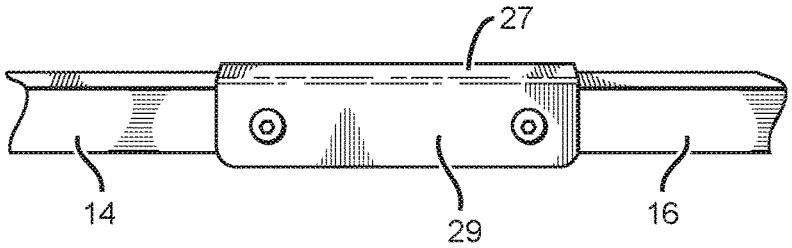
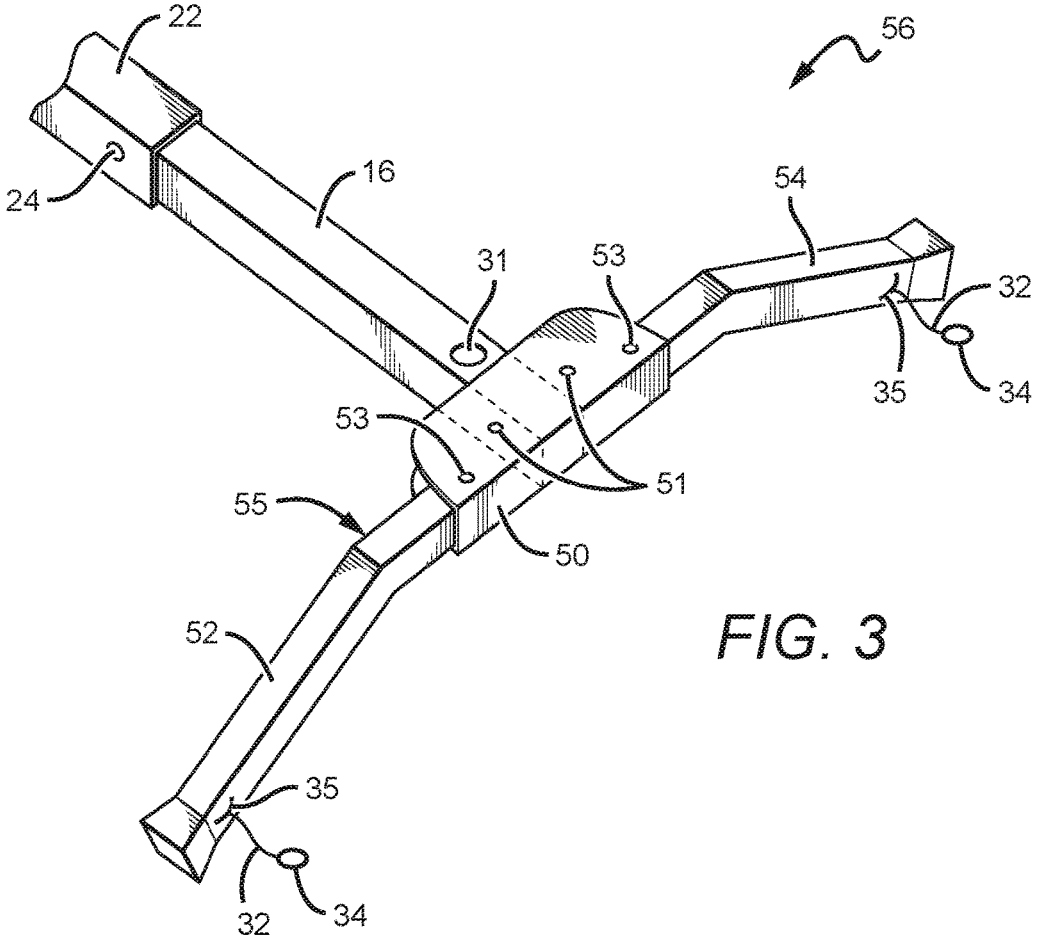
FIG. 3

COLLAPSIBLE AND PORTABLE SPORTS NET APPARATUS

RELATED APPLICATION

This application is a continuation application of Ser. No. 15/068,354 to David Nelson et al., filed on Mar. 11, 2016, which is a continuation application of Ser. No. 13/485,775 to David Nelson et al., filed on May 31, 2012, now U.S. Pat. No. 9,283,455, which claims the benefit of priority of U.S. Provisional Application Ser. No. 61/492,010, filed on Jun. 1, 2011. The contents of Ser. Nos. 13/485,775, 15/068,354, and 61/492,010, including their drawings, schematics, diagrams and written description, are hereby incorporated in their entirety by reference.

BACKGROUND OF THE INVENTION

Field of the Invention

This invention relates to a net apparatus adapted to be used in sports-related activities. More specifically, the invention is directed to a net apparatus that is configured to be collapsible to allow for ease of portability, transport and assembly.

Description of the Related Art

Various sports such as soccer or baseball involve hitting or throwing projectiles such as soccer balls or baseballs toward a desired direction in a field. For practice purposes, it is desirable to capture the ball before it travels a large distance or strikes objects or people. Existing capturing structures include a net attached to the perimeter of a capturing frame and a rigid support frame attached to the capturing frame. The support frame is attached to the capturing frame and provides a base allowing the capturing structure to be disposed on the ground.

A disadvantage of such structures is that they cannot be easily collapsed and efficiently stored. This is because both the support frame and the capturing frame must be properly folded and placed in a container. Further use of a capturing frame and a supporting frame makes such structures more expensive to manufacture and harder to carry due to increased weight.

There are portable net apparatuses available, and they tend to have members that are formed from a single continuous piece or formed from numerous smaller pieces. A disadvantage of nets formed of a single continuous piece is that they cannot be easily collapsed and efficiently stored due in part to its size. For example, a portable soccer goal can be formed of a single continuous frame wherein wheels are attached to a base to allow the soccer goal to be transported or wheeled out to a desired location. Although portable, transporting or positioning the soccer goal can be cumbersome, especially if the soccer goal is a regulation sized goal.

Portable goals formed of numerous pieces are more likely to be collapsible and easy transport, but have the distinct disadvantage of being difficult and slow to set up. For instance, loose fasteners may require tools for driving or tightening, and may also become lost in transit or storage or during assembly of the goal on the playing surface. Additionally, collapsible goals or nets may have components that are attached using lockable hinges. The hinges on such goals or nets typically require a locking device to hold the frame of the goal or net in a stable and locked position. Operation of the locking device of a typical hinge normally requires a person to press a button or release/attach a clip to collapse or deploy the goal or net. Pressing the button or releasing/attaching the clip could cause injury to a person, even if performed with care. Furthermore, if such locking device were to malfunction or break, the hinge would be ineffective at holding the support frame of the goal; thereby rendering the goal inoperable.

SUMMARY

The invention disclosed herein provides various embodiments of a net apparatus that are cost effective, easy to assemble/disassemble, easily transportable and provide the required structural support to receive or capture a projectile such as but not limited to a soccer ball or baseball. The different embodiments comprise elements to allow for the net apparatus to be collapsible, easy to transport between locations and yet provide a sufficiently sized net to allow for sports practice or training, such as but not limited to soccer or baseball. The invention is also configured such that the net apparatus can be easily assembled or disassembled by a single individual.

In one embodiment, as broadly described herein, a net apparatus comprises a base structure including at least one support portion, at least one base extension, and a hinge, wherein the at least one support portion is coupled to the at least one base extension and the hinge. At least one rod is removably coupled to the base structure and received by a net, wherein the net is adapted to exert a pulling force on the at least one rod causing the at least one rod to exert a torque force onto said hinge in order to lock the at least one support portion in place.

In another embodiment, the net apparatus comprises a base structure including first and second support portions pivotally attached to a hinge, a plurality of rods coupled to the base structure, and a net received by the plurality of rods, wherein the rods are configured to exert a force on the hinge in order to prevent rotation of the first and second support portions. The base structure, rods and net, when fully deployed, are adapted to withstand the force of a ball or projectile so as to capture the ball and to maintain the net apparatus in an upright position.

These and other aspects and advantages of the invention will become apparent from the following detailed description and the accompanying drawings which illustrate by way of example the features of the invention.

BRIEF DESCRIPTION OF THE DRAWINGS

FIG. 2*c* is a side view of the hinge of the net apparatus of FIG. 1;

FIG. 3 is a partial perspective view of one embodiment of a base structure of a net apparatus according to the invention;

DETAILED DESCRIPTION

Figure 1:
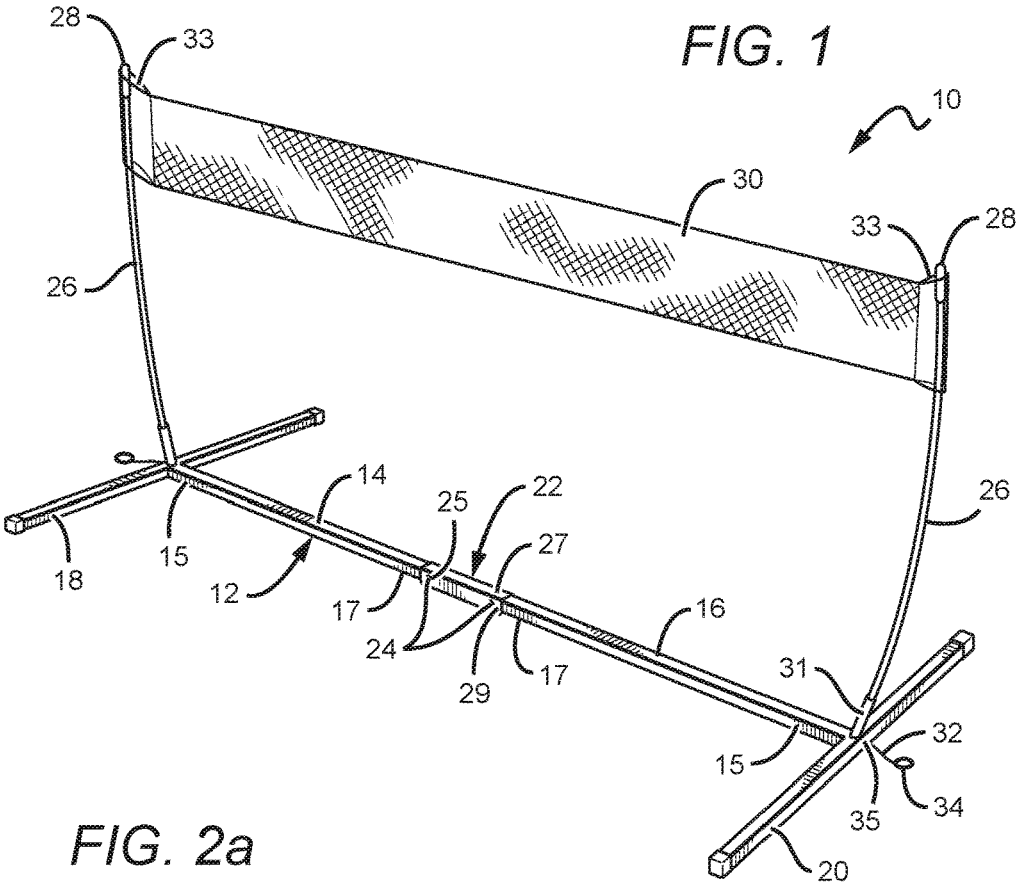
FIG. 1 is a perspective view of one embodiment of a net apparatus according to the invention.

The invention described herein is directed to different embodiments of net apparatuses that in some embodiments provide a frame structure that is easy to setup and is collapsible such that the frame structure is easy to assemble by a single individual, store and is portable. The net apparatus can comprise many different materials and can be used in many different applications such as, but not limited to, practicing soccer skills, throwing and/or hitting baseballs. The net apparatus according to the present invention can be arranged in many different ways with many different components, and is generally arranged to provide a net structure to capture or catch a projectile. In one embodiment, a net apparatus comprises a base structure including at least one support portion and at least one base extension. The net apparatus further comprises a hinge, wherein the at least one support portion is coupled to the at least one base extension and the hinge. At least one rod is removably coupled to the base structure and is adapted to be received by a net. The net is adapted to exert a pulling force on the at least one rod causing the at least one rod to exert a torque force onto said hinge, whereby the at least one support portion is locked into place. In other embodiments, the net apparatus comprises a base structure including a first support portion and a second support portion, wherein the first and second support portions are attached to a hinge, such that the first and second support portions are opposite each other and the hinge is interposed therebetween. At least one rod is removably received by the base structure, wherein a net is adapted to receive the at least one rod. The net apparatus further comprises a first base extension coupled to the first support portion and a second base extension coupled to the second support portion. The base extensions are adapted to further support the load of the net apparatus and allow the net apparatus to remain upright while in use. In some embodiments, the net apparatus can also comprise an attachment device proximate the base structure, such that the attachment device is adapted to receive an attachment cord that is adapted to receive a weighted device or force resistance device to provide additional structural support. An advantage of the net apparatus is that the net apparatus is configured to exert a force on the hinge so as to maintain the net apparatus in an upright state when deployed. This arrangement allows the hinge to remain in a fixed state without the need of one or more locking devices to lock the support portion to the hinge.

The net apparatus of the present invention can provide a number of additional advantages beyond those mentioned above. For example, the hinge allows for ease of assembly/disassembly and storage of the net apparatus because the hinge does not have a locking device that needs to be forcibly engaged and/or disengaged. Typical hinges have a locking pin that prevents an element from pivoting about a hinge. These locking pins can be hard to engage and/or disengage which could cause injury to the person trying to engage and/or disengage the locking pin. Other typical hinges have a locking button, instead of a locking pin, that is depressed in order to allow an element to be engaged and/or disengaged from the hinge. In such hinges, operation of the locking button requires the person to press down and pivot the element about the hinge. In some instances, the person pressing the locking button could get a portion of their finger caught and/or pinched by the button causing injury. Another advantage of the invention is that the net apparatus is collapsible such that the net apparatus can be folded upon itself and form a smaller package that can easily be transported and/or stored without taking up too much physical space. A disadvantage of hinges having the locking pin or the locking button is that the locking pin or the locking button will deteriorate over time due to many different factors, such as the load imparted onto them or by damage due to repeated use or misuse.

Some embodiments of the net apparatus according to the invention can be used to stop or capture a ball or the like when performing sports-related activities. However, the invention is not intended to be limited to such embodiments. As further described below, the net apparatus can be arranged to allow an individual to easily deploy and disassemble the net apparatus in an outdoor or indoor setting.

The invention is described herein with reference to certain embodiments, but it is understood that the invention can be embodied in many different forms and should not be construed as limited to the embodiments set forth herein. In particular, the present invention is described below in regards to a net apparatus to practice or perform sports-related activities in an outdoor setting, but it is understood that the invention can be used for many other applications in many different settings. The components of the net apparatus can have different shapes and sizes beyond those shown in the figures or discussed herein.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the device in addition to the orientation depicted in the figures.

Embodiments of the invention are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

Figure 2A:
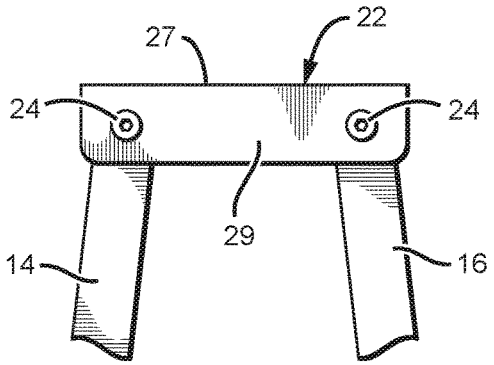
FIG. 2*a* is a side view of a hinge of the net apparatus of FIG. 1.
Figure 2B:
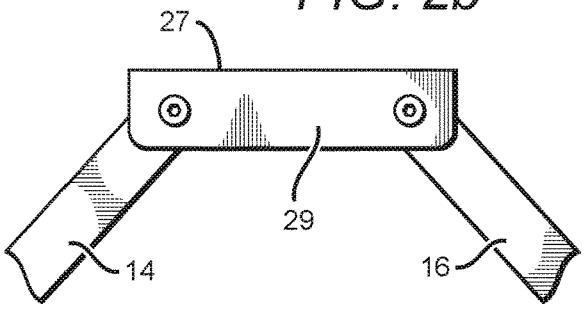
FIG. 2*b* is a side view of the hinge of the net apparatus of FIG. 1.

FIGS. 1-2*c* show one embodiment of a net apparatus 10 according to an embodiment of the invention. In some embodiments, the net apparatus 10 is configured such that the net apparatus 10 can be deployed in an outdoor setting such as, but not limited to, a natural grass, synthetic field, dirt, concrete or the like. In other embodiments, the net apparatus 10 can be deployed in an indoor setting such as but not limited to an indoor training facility, residential or commercial setting having a synthetic or natural surface, or the like. The net apparatus 10 can then be used in sports-related activities, such as but not limited to baseball, softball, soccer, football and the like. The net apparatus 10 can also be used to allow users to practice kicking, hitting or throwing a ball or other projectile to the net apparatus 10, such that the net apparatus captures or catches the ball so that the user does not have to travel great distances to retrieve the ball. The net apparatus 10 comprises a base structure 12 including first and second support portions 14, 16 pivotally attached to a hinge 22, a plurality of rods 26 removably coupled to the base structure 12, and a net 30 adapted to receive the plurality of rods 26. The embodiment shown in FIG. 1 has two rods 26, but other embodiments can have more than two rods 26. The rods 26 are configured to exert a force on the hinge 22 in order to lock the first and second support portions 14, 16 in place and prevent rotation of the first and second portions 14, 16 about the hinge 22. The base structure 12, rods 26 and net 30, when fully assembled and deployed, are adapted to withstand the force of a ball or projectile so as to capture the ball while keeping the net apparatus 10 in an upright position.

For the same or similar elements or features, the reference numbers from FIGS. 1-2*c* will be used throughout the application herein. In one embodiment of the invention, the base structure 12 can further comprise a first base extension 18 coupled to the first support portion 14 and a second base extension 20 coupled to the second support portion 16. This arrangement allows the first and second base extensions 18, 20 to provide additional structural support to further stabilize the net apparatus 10 in an upright position. In some embodiments, the first and second base extensions 18, 20 can be coupled to the respective support portions 14, 16 such that the first and second base extensions 18, 20 are perpendicular to the respective support portion 14, 16. In other embodiments, the first and second base extensions 18, 20 can be angled in a V-shaped configuration and configured to raise the base structure 12 above the ground or surface or allow the base structure 12 to contact the ground or surface, wherein the angle of the V-shaped base extensions 18, 20 can be in the range of 90°-140° (degrees). In yet other embodiments, as in FIG. 3, a base extension 55 comprises a base extension hinge 50 coupled to the support portions 16 and 14 (not shown), first and second base extension legs 52, 54 pivotally attached to the base extension hinge 50 about a respective pivot point 51, and can be locked into place by respective locking pins/buttons 53. In this arrangement, the legs 52, 54 can be released from their respective locking pins/buttons 53 and are able to rotate about pivot points 51 towards the support portions 16 and 14 such that the base structure 56 is further collapsible and easy to transport. In the embodiment of FIG. 1, the base extensions 18, 20 are stationary and are not able to be rotated towards their respective support portion 14, 16. Additionally, the first and second legs 52, 54, in FIG. 3, are arranged, either bent, curved, or straight, such that the base structure 56 is elevated off the ground or surface. However, in other embodiments, the legs 52, 54 can be arranged to allow the base structure 56 to contact the ground or surface. The legs 52, 54 can also comprise the attachment device 33, attachment cord 32 and ring 34 as discussed in the embodiment of FIG. 1.

The first and second support portions 14, 16 each have a first end 15 and a second end 17, wherein the first end 15 of each of the support portions 14, 16 is coupled to the respective base extensions 18, 20. The first and second support portions 14, 16 extend from the respective base extensions 18, 20 towards a hinge 22 and are pivotally coupled to the hinge 22, such that the base extensions 18, 20 are opposite the hinge 22. The second ends 17 of support portions 14, 16 are coupled to the hinge 22 using hinge pins 24. The hinge 22 has openings 25 that receive the hinge pins 24 so as to couple the support portions 14, 16 to the hinge 22. In one embodiment, the hinge pins 24 can be screws with a nut to hold the screw in place. However, in other embodiments, the openings 25 of the hinge 22 can be threaded to receive the hinge pins 24, or the hinge pins can be nails, rivets or the like. The support portions 14, 16 can be coupled to the hinge 22 using various known means in the art and is not intended to be limited to the embodiments disclosed herein. The first and second support portions 14, 16 can be made of many different materials, such as but not limited to wood, plastic, metal, a composition thereof or the like. The first and second support portions 14, 16 can be formed to have many different shapes, such as but not limited to circular, square, polygonal, a combination thereof or the like. The first and second portions 14, 16 of the embodiment of FIGS. 1-2*c* are shown as having a square-like shape.

The hinge 22 is arranged to receive at least a portion of the first and second support portions 14, 16 such that the support portions 14, 16 are able to rotate about the respective hinge pin 24. In one embodiment, the hinge 22 is configured to be a U-shaped channel having a hinge base 27, sidewalls 29 and openings 25 to allow respective hinge pins 24 to be received by the hinge 22 as well as the first and second support portions 14, 16, such that the first and second support portions 14, 16 are pivotally coupled to hinge 22. In the embodiment of FIG. 1, the second ends 17 of each of the first and second support portions 14, 16 are pivotally coupled to the hinge 22. However, in other embodiments, the first and second support portions 14, 16 can be pivotally coupled to the hinge 22 at different locations between the first and second ends 15, 17.

An advantage of the invention is that in some embodiments the hinge 22 can be U-shaped which allows the hinge 22 to hold the first and second support portions 14, 16 in a stable and parallel position along the same axis and also provides a physical stop which prevents the first and second support portions 14, 16 from pivoting beyond the physical stop. However, in other embodiments, the hinge 22 can be shaped in different forms such that the support portions 14, 16 are not aligned along the same axis, can be parallel or non-parallel, yet still provide a physical stop to prevent the portions 14, 16 from rotating beyond the physical stop.

As shown in FIGS. 1-2*c*, the first and second portions 14, 16 are coupled to the hinge 22, using hinge pins 24, such that they rotate about the respective hinge pin 24. Rotation of the first support portion 14, in a direction opposite the second support portion 16, about the hinge pin 24 will stop when the first support portion 14 comes into contact with the hinge base 27 of the hinge 22; FIG. 2*c* shows an example of the support portions 14, 16 in contact with the hinge base 27 and precluding further rotation. The hinge base 27 provides a physical stop and prevents the first support portion 14 from further rotation. The second support portion 16 is similarly configured as the first support portion 14 and will stop rotating about hinge pin 24 when the second support portion 16 contacts the hinge base 27. The physical stop provided by the hinge 22 properly aligns the first and second support portions 14, 16 when assembling the net apparatus 10. Yet another advantage of the invention is that the hinge 22 allows the base structure 12 to be folded onto itself so that the net apparatus 10 can be easily stored as well as easy to transport. This arrangement allows the base structure 12 to reduce its size and/or area, thereby allowing the net apparatus 10 to be stored in a small container.

When assembling the net apparatus 10, the first and second support portions 14, 16 of the base structure 12 are rotated away from the opposite support portion 16, 14 towards the hinge base 27. When the support portions 14, 16 are in contact with the hinge base 27, precluding further rotation, the base structure 12 is ready to be placed on the playing surface, such as but not limited to a natural grass, synthetic filed, cement, wood, asphalt, or the like. The base structure 12 is placed on the playing surface such that the hinge base 27 is opposite the playing surface. In other words, the hinge base 27 does not contact the surface upon which the base structure 12 is positioned on. At this point, the at least one rod 26 is ready to be installed.

The base structure 12 is further adapted to receive the at least one rod 26. In one embodiment, the base structure 12 comprises at least one shaft 31 extending substantially vertically and configured to receive one of the at least one rod 26. In another embodiment, the base structure 12 comprises a plurality of shafts 31, wherein each respective shaft 31 is adapted to receive a respective one of the at least one rod 26. In the embodiment of FIG. 1, the base structure 12 comprises two shafts 31, with one shaft 31 coupled to the first base extension 18 and another shaft 31 coupled to the second base extension 20. As shown in FIG. 1, each of the shafts 31 are coupled to a respective base extension 18, 20 proximate the first end 15 of the first and second support portions 14, 16. However, in other embodiments, the shaft 31 can be positioned at various other locations on the base extensions 18, 20 and/or the support portions 14, 16, or a combination thereof. In yet other embodiments, the base structure 12 can comprise more than two shafts 31 for embodiments that comprise more than two rods 26. The number of shafts 31 present will be equal to the number of rods 26.

The at least one rods 26 are configured to be securely held within the shaft 31, such that the shaft 31 maintains a stable structural connection between the shaft 31 and the at least one rods 26 and prevents the rod 26 from being removed from the shaft 31 when the net apparatus 10 is assembled. In one embodiment of the invention, the shaft 31 is similarly shaped as the rod 26, such as but not limited to cylindrically shaped, and is slightly larger than the rod 26 such that the rod 26 can easily be received by the shaft 31. The shaft 31 can further comprise a sheath contacting the inner wall of the shaft 31 that receives the rod 26. The sheath is adapted to protect the rod 26 within the shaft 31 from forces exerted on the rod 26 when the net apparatus 10 is fully assembled. As will be discussed below, upon assembly of the net apparatus 10, the rods 26 experience a moment force at the point where the rod 26 is received by the shaft 31, and causes the rod 26 to exert a compression force upon the sheath. The sheath thereby protects the rod 26 from the forces exerted on and/or by the rod 26.

In other embodiments, the shaft 31 can be shaped such that the radius of the shaft 31 decreases the further the rod 26 is inserted into the shaft 31. In this arrangement, the shaft 31 uses a compression force to form the structural connection between the shaft 31 and the rod 26. In other embodiments, mechanical devices, such as but not limited to, screws, nuts, nails, rivets or the like, can be used to form the structural connection so as to securely attach the rod 26 to the shaft 31. In yet other embodiments, the rods 26 can be configured to have an attachment means such that the rods 26 can be attached to the shaft 31; non-limiting examples of such attachment means are the rods 26 being threaded and screwed into the shaft 31 or the rod 26 and shaft 31 configured similarly like a bayonet-type locking device.

In the embodiment of FIG. 1, the rods 26 are circularly shaped and the shaft 31 is also correspondingly circularly shaped to receive the rod 26. The shape of the rod 26 and shaft 31 is not intended to be limited to a circular shape, other shapes such as quadrilateral, triangular, or any other polygonal shape can be used. The shaft 31 can also be similarly shaped as the rod 26, but in some embodiments, the shaft 31 can be shaped differently than the rod 26. The rods 26 can be made of many different materials known in the art, such as but not limited to fiberglass or carbon fiber, such that the rods 26 are flexible, elastic, capable of returning to an initial form or state after deformation, and able to withstand the impact forces applied by sports-related balls and/or other projectiles that can be captured or caught by the net apparatus 10, or thrown, kicked, and/or hit towards the net apparatus 10.

The rods 26, when received by the shaft 31 flare outwards in a direction opposite the hinge 22, such that the rods 26 are in a relaxed state and are substantially straight. A net 30 comprising at least one sleeve 33 is arranged to receive the at least one rod 26 and is adapted to exert a force on the at least one rod 26 bending the at least one rod 26 into a flexed state. Inserting the at least one rod 26 into the sleeve 33 requires that the at least one rod 26 be bent from the relaxed state into a flexed state to allow the sleeve 33 to receive the at least one rod 26. As shown in the embodiment of the invention in FIG. 1, when both rods 26 are received by the respective shaft 31 and the net 30, both rods 26 are bent in a direction towards the hinge 22 and into the flexed state. Removal of the net 30 allows the rods 26 to return to their original form of the relaxed state. Repeated use of the net apparatus 10 does not result in the rods 26 being permanently bent in a shape similar to that of the flexed state. The net 30 can be easily installed and removed by a single individual.

The net 30 imparts a pulling force on each of the rods 26 which causes each of the rods 26 to bend in a direction towards the hinge 22. Once bent towards the hinge 22, the rods 26 are in the flexed state and experience a moment force about its pivot point. The pivot point of each of the rods 26 corresponds to the point at which the rods 26 are received by the shaft 31. The moment force experienced by the rods 26 is imparted onto the hinge 22 and the first and second support portions 14, 16 of the base structure 12, with the transferred force being greatest at the hinge 22. This transferred force further assists in locking the hinge 22 and base structure 12, such that the first and second support portions 14, 16 are locked into place.

An advantage of the invention is that the force exerted onto the rods 26 by the net 30 results in a torque force experienced by the rods 26 and transferred to the hinge 22, which allows the hinge 22 to lock the first and second support portions 14, 16 into place without the need of a locking device such as a locking clip or button. The absence of such a locking device on the hinge 22 prolongs the lifetime of the net apparatus 10 due, in part, to the hinge 22 not deteriorating or breaking down due to failure or malfunctioning of the locking clip or button.

Figure 4:
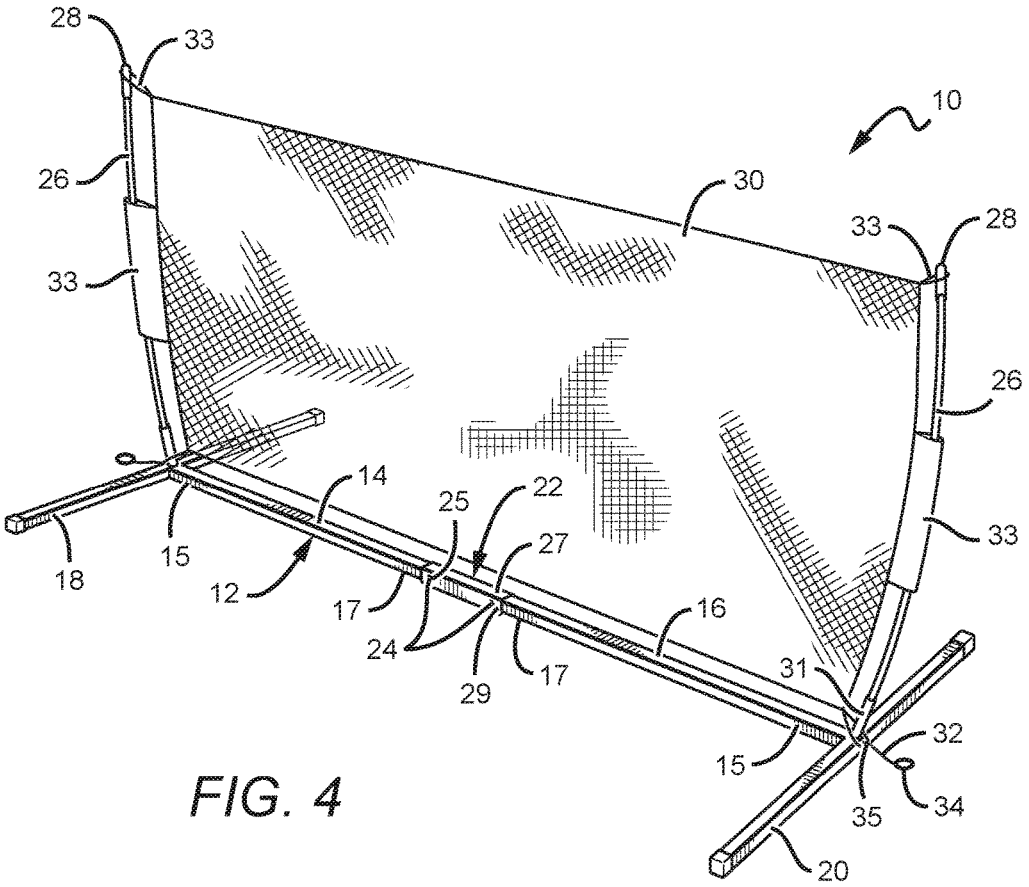
FIG. 4 is a perspective view of another embodiment of a net apparatus according to the invention.

The net 30 can be a mesh surface or any typical net known in the art. The net comprises at least one sleeve 33 adapted to receive the rod 26 so at to mount the net 30 onto the rods 26. The embodiment of FIG. 1 shows the net 30 having a sleeve 33 in the form of a plurality of loops that receive the rods 26. However, in other embodiments, such as FIG. 4, the net 30 comprises a plurality of sleeves 33 wherein at least one of the plurality of sleeves 33 receives the base structure 12, in order to provide additional structural support for the net apparatus 10. The sleeve 33 can be configured in many different ways, such as but not limited to a sleeve that spans the length of the rod, a plurality of smaller sleeves that are spaced apart from each other and run along the length of the rods 26, or a sleeve that spans along a partial length of the rods 26. In some embodiments, each rod 26 comprises an endcap 28 opposite the portion of the rod 26 that is received by the shaft 31 and is configured to receive at least a portion of the sleeve 33, such that the endcap 28 prevents the sleeve 33 from coming off the rods 26 while the net apparatus 10 is assembled and/or in use. In one embodiment, the endcaps 28 can have a tab that extends outward beyond the external shape of the rod 26 that prevents the net 30 from coming off the rod 26. However, in other embodiments, the endcaps 28 can have other means of preventing the net 30 from coming off the rod 26, such as but not limited to a hook, loop, locking clip, or the like.

The net apparatus 10 according to the invention is designed to withstand the force of a ball or other projectile so as to catch or capture the ball, such that the net apparatus 10 maintains an upright standing position. In some embodiments of the invention, the net apparatus 10 can comprise at least one attachment device 35 that can receive an attachment cord 32 having a ring 34. The attachment cord 32 allows for the connection of a weight, stake or similar device to provide additional support for the net apparatus 10. In the embodiment of FIG. 1, the attachment device 35 is a loop-like device that is coupled to the base structure 10 and allows the attachment cord 32 to be tied or coupled to the attachment device 35. The attachment cord 32 can be a bungee cord, rope, or the like. The ring 34 allows for a weighted or force-resistant device (not shown), such as but not limited to a sandbag or a suction cup, to be attached to the base structure 12 to provide additional support for the net apparatus 10 and prevent the net apparatus 10 from moving, falling over, or shifting. The ring 34 can also be used to receive a stake, staple, hook or similar device that is inserted into the ground or surface so as to attach the net apparatus 10 to the ground or surface.

The attachment device 35 is configured to extend laterally or horizontally from the base structure 12, such that the weight or similar device attached to the cord 32 provides a lateral support, which prevents the net apparatus 10 from lifting upwards or shifting its position. An advantage of this arrangement is that the weight or similar device attached to the attachment device 35 can also act as a shock absorber when a ball or projectile is caught or captured by the net apparatus 10. The force of the ball is distributed throughout the net apparatus 10 and also partially transferred to the weight or device attached to the attachment device 35, which further provides additional support to the net apparatus 10 which increases the stability and/or the force the net apparatus 10 can withstand. In other embodiments of the invention, the net apparatus 10 comprises a plurality of attachment devices 35 and can be disposed on the base structure 12 and/or on base extensions 18, 20.

Although the invention has been described in considerable detail with reference to certain configurations thereof, other versions are possible. Net apparatuses according to the invention can be many different sizes and can be used for many different applications, other than for sports-related activities. The net apparatus can comprise net sidewalls to form an enclosure, similar to a soccer goal, lacrosse goal or the like, wherein each base extension comprises a plurality of shafts that receive a respective one of a plurality of rods. The net apparatus can also include a plurality of hinges that lock its base structure to the hinge using the force exerted onto the hinge from the frame structure of the net apparatus. In other embodiments, the support portions can be adjustable to make a smaller or bigger base structure, while the size of the rods can also be adjusted to make a smaller or bigger net apparatus. In other embodiments, the rods can be made of a single piece of material, whereas in other embodiments, the rods can be comprised of a plurality of rod pieces that are joined together to form the rod. Therefore, the spirit and scope of the invention should not be limited to the versions described above.

We claim:

1. A net apparatus, comprising:

a support portion having a length in a first plane;

a first base extension coupled to the support portion at a first end of the support portion;

a second base extension coupled to the support portion at a second end of the support portion;

a first rod removably coupled to the first base extension, wherein the first base extension is configured to support the first rod at a first fixed angle;

a second rod removably coupled to the second base extension, wherein the second base extension is configured to support the second rod at a second fixed angle; and a net, coupled to the at least a first rod and to the at least a second rod, the net bending the first rod and the second rod from a linear state into an arcuate state along a length of the at least a first rod and along a length of the at least a second rod, such that a net tension pulls the at least a first rod into the arcuate state and the net tension simultaneously pulls the at least a second rod into the arcuate state, wherein the net is coupled to the first and second rods along a plurality of positions along the first and second rods, such that a first edge of the net adjacent the first rod and a second edge of the net adjacent the second rod are each substantially in an arcuate state, in which the first rod and the second rod are in a second plane substantially normal to the first plane;

wherein the support portion comprises a support portion hinge between the first end of the support portion and the second end of the support portion, wherein the support portion pivots substantially in a third plane, wherein the third plane is substantially perpendicular to the first plane.

2. The net apparatus of claim 1, wherein the first base extension comprises a first shaft proximate the first end of the support portion, wherein the first shaft receives the first rod and supports the first rod at the first fixed angle.

3. The net apparatus of claim 2, wherein the first shaft extends out of the first plane.

4. The net apparatus of claim 1, wherein the second base extension comprises a second shaft proximate the second end of the support portion, wherein the second shaft receives the second rod and supports the second rod at the second fixed angle.

5. The net apparatus of claim 4, wherein the second shaft extends out of the first plane.

6. The net apparatus of claim 1, wherein the first and second base extensions are pivotally coupled to the support portion, such that the first base extension pivots about a first pivot point and the second base extension pivots about a second pivot point, in which the first base extension and the second base extension pivot substantially in the first plane.

7. The net apparatus of claim 6, wherein a first hinge is coupled to the first end of the support portion, such that the first hinge pivotally couples the first base extension to the support portion.

8. The net apparatus of claim 6, wherein a second hinge is coupled to the second end of the support portion, such that the second hinge pivotally couples the second base extension to the support portion.

9. The net apparatus of claim 1, wherein the support portion pivots about a first support pivot of the support portion hinge and pivots about a second support pivot of the support portion hinge.

10. A net apparatus, comprising:

a support portion having a length in a first plane;

a first base extension coupled to the support portion at a first end of the support portion;

a second base extension coupled to the support portion at a second end of the support portion;

a first rod removably coupled to the support portion proximate the first end of the support portion, wherein the support portion is configured to support the first rod at a first fixed angle;

a second rod removably coupled to the support portion proximate the second end of the support portion, wherein the support portion is configured to support the second rod at a second fixed angle; and a net, coupled to the at least a first rod and to the at least a second rod, the net bending the first rod and the second rod from the first and second fixed angles into an arcuate state, such that a net tension pulls the at least a first rod into the arcuate state and the net tension simultaneously pulls the at least a second rod into the arcuate state, wherein the net is coupled to the first and second rods along a plurality of positions along the first and second rods, in which the first rod and the second rod are in a second plane substantially normal to the first plane;

wherein the support portion comprises a support portion hinge between the first end of the support portion and the second end of the support portion, wherein the support portion hinge is locked solely by the net tension pulling the first rod into the arcuate state and the net tension pulling the second rod into the arcuate state, such that the support portion hinge is unlocked when the first rod is in the linear state or the second rod is in the linear state.

11. The net apparatus of claim 10, wherein the support portion comprises a first shaft, wherein the first shaft receives the first rod and supports the first rod at the first fixed angle.

12. The net apparatus of claim 10, wherein the support portion comprises a second shaft, wherein the second shaft receives the second rod and supports the second rod at the second fixed angle.

13. The net apparatus of claim 10, wherein a first hinge is coupled to the support portion at the first end of the support portion, wherein the first base extension is coupled to the first hinge such that the first base extension is pivotally coupled to the support portion.

14. The net apparatus of claim 13, wherein the first base extension comprises at least a first base extension leg, wherein the at least a first base extension leg pivots about a first pivot point of the first hinge.

15. The net apparatus of claim 10, wherein a second hinge is coupled to the support portion at the second end of the support portion, wherein the second base extension is coupled to the second hinge such that the second base extension is pivotally coupled to the support portion.

16. The net apparatus of claim 15, wherein the second base extension comprises at least a second base extension leg, wherein the at least a second base extension leg pivots about a second pivot point of the second hinge.

17. The net apparatus of claim 10, wherein the support portion pivots substantially in a third plane, wherein the third plane is substantially parallel to the second plane.

18. A net apparatus, comprising:

a base structure having a first support portion, a second support portion, at least one first base extension, and at least one second base extension, wherein the at least one first base extension is coupled to a first end of the first support portion, and the at least one second base extension is coupled to a second end of the second support portion;

a support portion hinge adapted to receive the first and second support portions, such that the first and second support portions rotate about a pivot of the support portion hinge;

at least two flexible rods removably coupled to the base structure, wherein a first flexible rod is proximate to the first end of the support portion and the at least one first base extension, wherein a second flexible rod is proximate to the second end of the support portion and the at least one second base extension; and a net adapted to receive the at least two flexible rods such that the at least two flexible rods exert a force onto at least the support portion hinge to secure the first support portion and the second support portion in an open position within the support portion hinge, the net comprising a plurality of sleeves configured to receive the at least two flexible rods along a plurality of positions along the first and second rods, wherein at least one of the plurality of sleeves is adapted to be coupled to and retained by an endcap of the first flexible rod and the second flexible rod, such that the net bends the first and second flexible rods from a straight relaxed state into a bow-shaped flexed state along a length of the first flexible rod and along a length of the second flexible rod such that a first edge of the net adjacent the first rod and a second edge of the net adjacent the second rod are each in a substantially corresponding bow-shape, wherein the support portion hinge is unlocked in the absence of the net.

19. The net apparatus of claim 18, wherein the first support portion comprises a first shaft to receive the first flexible rod, wherein the second support portion comprises a second shaft to receive the second flexible rod.

20. The net apparatus of claim 18, wherein the at least one first base extension comprises a first shaft to receive the first flexible rod, wherein the at least one second base extension comprises a second shaft to receive the second flexible rod.

21. The net apparatus of claim 18, wherein a first hinge is coupled to the first support portion at the first end of the first support portion, wherein the at least one first base extension is coupled to the first hinge, such that the at least one first base extension pivots about a pivot point of the first hinge.

22. The net apparatus of claim 21, wherein a second hinge is coupled to the second support portion at the first end of the second support portion, wherein the at least one second base extension is coupled to the second hinge, such that the at least one second base extension pivots about a pivot point of the second hinge.

23. The net apparatus of claim 22, wherein the base structure further comprises at least one shaft, wherein a first shaft receives the first flexible rod and a second shaft receives the second flexible rod, wherein the first shaft is proximate the first hinge, wherein the second shaft is proximate the second hinge.

24. A net apparatus, comprising:

a base structure having at least a first and a second support portion, and at least a first and a second base extension coupled to a respective one of the first and second support portions such that the respective support portion is disposed between the endpoints of the respective base extension;

a hinge configured to receive the first and second support portions, such that the each of the first and second support portions are adapted to rotate about a respective pivot;

a plurality of rods, each of the rods removably coupled to the base structure proximate to at least one of the first and second base extensions and at least one of the first and second support portions, each of the rods comprising an endcap on an upper end such that a lower end of a respective rod is received by the base structure, wherein each rod is flexible; and a net adapted to receive the plurality of rods such that the rods are adapted to exert a torque force onto at least one of the hinge, the base structure, or a combination thereof to lock the at least one support portion, the net comprising a plurality of sleeves configured to receive the plurality of rods along a plurality of positions along each respective rod and the base structure, wherein at least one of the plurality of sleeves is adapted to be coupled to and retained by the endcap, wherein at least another one of the plurality of sleeves adapted to be coupled to a respective one of the plurality of rods between the upper and lower ends, wherein the net is adapted to bend the plurality of rods such that the plurality of rods are in a bow-shaped flexed state, wherein at least a first edge of the net is adjacent the first rod and is bow-shaped, wherein the at least one support portion is unlocked in the absence of the net.

25. A net apparatus, comprising:

a base structure comprising:

first and second support portions;

first and second base extensions, the first base extension coupled to the first support portion and the second base extension coupled to the second support portion, wherein the first and second support portions are disposed between the endpoints of the first and second base extensions;

a plurality of shafts, at least one first shaft coupled to the first support portion and at least one second shaft coupled to the second support portion; and a hinge configured to receive the first and second support portions, such that the first and second support portions are pivotally attached to the hinge;

a plurality of rods, at least one first rod removably coupled to the at least one first shaft and at least one second rod removably coupled to the at least one second shaft, wherein the at least one first and second rods are flexible; and a net adapted to receive at least a portion of the at least one first rod and at least a portion of the at least one second rod such that the at least one first and second rods are adapted to exert a torque force onto at least one of the hinge, the base structure, or a combination thereof to lock the first and second support portions, the net comprising a plurality of sleeves configured to receive the plurality of rods and the base structure, wherein a first sleeve is adapted to be coupled to and retained by the endcap of at least one of the plurality of rods and a second sleeve that spans along part of the length of at least one of the plurality of rods, wherein the net is adapted to bend the at least one of the plurality of rods such that the at least one of the plurality of rods is in a bow-shaped flexed state, wherein the first and second support portions are unlocked in the absence of the net.

* * * * *